US005560080A

United States Patent [19]

Reed

[11] Patent Number: 5,560,080

[45] Date of Patent: Oct. 1, 1996

[54] DOOR HINGE LOCKING DEVICE

[76] Inventor: Kevin M. Reed, 11010 W. Poinsettia Dr., Avondale, Ariz. 85323

[21] Appl. No.: 362,770

[22] Filed: Dec. 23, 1994

[51] Int. Cl.[6] ..... E05F 5/02

[52] U.S. Cl. ..... 16/82; 16/374

[58] Field of Search ..... 16/82, 339, 352, 16/353, 223, 374, 373, 50, 250, DIG. 21, 319; 292/288, 289, 342, 343, DIG. 15, DIG. 17

[56] References Cited

U.S. PATENT DOCUMENTS

| | | | |
|---|---|---|---|
| 314,105 | 3/1885 | Carnes | 16/82 |
| 3,918,121 | 11/1975 | Williams | 16/82 |
| 4,738,002 | 4/1988 | Shank | 16/82 |
| 4,831,688 | 5/1989 | Deininger | 16/82 |
| 5,027,471 | 7/1991 | Barnes | 16/82 |

FOREIGN PATENT DOCUMENTS

| | | | |
|---|---|---|---|
| 469538 | 5/1954 | Italy | 16/82 |

*Primary Examiner*—Chuck Y. Mah

[57] ABSTRACT

A locking device for securing plates of a hinge together to preclude opening of an associated door. The inventive device includes an encapsulating block positionable over pivoting cylinders of a hinge to capture and retain plates of the hinge in an abutting relationship. The encapsulating block is shaped so as to define a flat engaging wall and an angled engaging wall which abut the door and an adjacent wall to further resist opening of the door.

3 Claims, 3 Drawing Sheets

32
14
16
26
24
34

10
12
20
22
18

DOOR HINGE LOCKING DEVICE

BACKGROUND OF THE INVENTION

1. Field of the Invention

The present invention relates to locking structures and more particularly pertains to an door hinge locking device for securing plates of a hinge together to preclude opening of an associated door.

2. Description of the Prior Art

The use of locking structures is known in the prior art. More specifically, locking structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art locking structures include U.S. Pat. No. 3,811,150; U.S. Pat. No. 3,744,085; U.S. Pat. No. 4,780,929; U.S. Pat. No. 4,564,974; and U.S. Pat. No. 3,969,788.

While these devices fulfill their respective, particular objectives and requirements, the aforementioned patents do not disclose a door hinge locking device for securing plates of a hinge together which includes an encapsulating block positionable over the pivoting cylinders of a hinge to capture and retain the plates of the hinge together to preclude opening of an associated door, wherein the encapsulating block is shaped so as to define a flat engaging wall and an angled engaging wall which abut the door and an adjacent wall to further resist opening of the door.

In these respects, the door hinge locking device according to the present invention substantially departs from the conventional concepts and designs of the prior art, and in so doing provides an apparatus primarily developed for the purpose of securing plates of a hinge together to preclude opening of an associated door.

SUMMARY OF THE INVENTION

In view of the foregoing disadvantages inherent in the known types of locking structures now present in the prior art, the present invention provides a new door hinge locking device construction wherein the same can be utilized for securing plates of a hinge together to preclude opening of an associated door. As such, the general purpose of the present invention, which will be described subsequently in greater detail, is to provide a new door hinge locking device apparatus and method which has many of the advantages of the locking structures mentioned heretofore and many novel features that result in a door hinge locking device which is not anticipated, rendered obvious, suggested, or even implied by any of the prior art locking structures, either alone or in any combination thereof.

To attain this, the present invention generally comprises a locking device for securing plates of a hinge together to preclude opening of an associated door. The inventive device includes an encapsulating block positionable over the pivoting cylinders of a hinge to capture and retain the plates of the hinge in an abutting relationship. The encapsulating block is shaped so as to define a flat engaging wall and an angled engaging wall which abut the door and an adjacent wall to further resist opening of the door.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new door hinge locking device apparatus and method which has many of the advantages of the locking structures mentioned heretofore and many novel features that result in a door hinge locking device which is not anticipated, rendered obvious, suggested, or even implied by any of the prior art locking structures, either alone or in any combination thereof.

It is another object of the present invention to provide a new door hinge locking device which may be easily and efficiently manufactured and marketed.

It is a further object of the present invention to provide a new door hinge locking device which is of a durable and reliable construction.

An even further object of the present invention is to provide a new door hinge locking device which is susceptible of a low cost of manufacture with regard to both materials and labor, and which accordingly is then susceptible of low prices of sale to the consuming public, thereby making such door hinge locking devices economically available to the buying public.

Still yet another object of the present invention is to provide a new door hinge locking device which provides in the apparatuses and methods of the prior art some of the advantages thereof, while simultaneously overcoming some of the disadvantages normally associated therewith.

Still another object of the present invention is to provide a new door hinge locking device for securing plates of a hinge together to preclude opening of an associated door.

Yet another object of the present invention is to provide a new door hinge locking device which includes an encapsulating block positionable over the pivoting cylinders of a hinge to capture and retain the plates of the hinge together to preclude opening of an associated door.

Even still another object of the present invention is to provide a new door hinge locking device wherein the encapsulating block is shaped so as to define a flat engaging wall and an angled engaging wall which abut the door and an adjacent wall to further resist opening of the door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
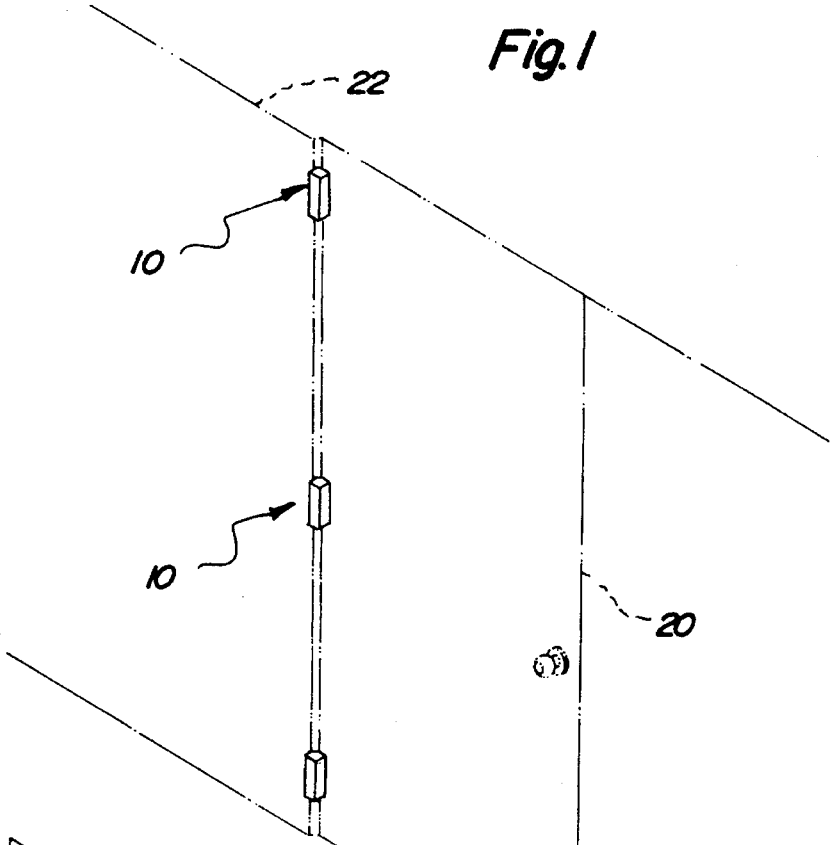
FIG. 1 is an isometric illustration of a plurality of door hinge locking devices according to the present invention in use.
Figure 2:
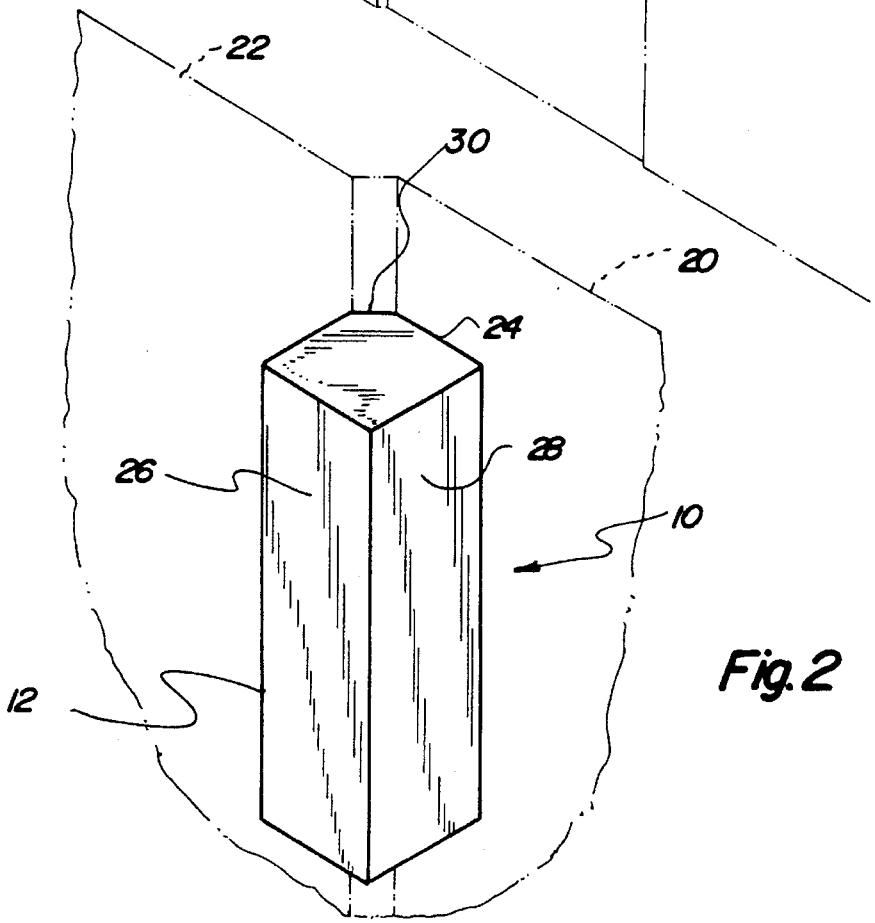
FIG. 2 is an enlarged isometric illustration of a single door hinge locking device.

With reference now to the drawings, and in particular to FIGS. 1–6 thereof, a new door hinge locking device embodying the principles and concepts of the present invention and generally designated by the reference numeral 10 will be described.

Figure 3:
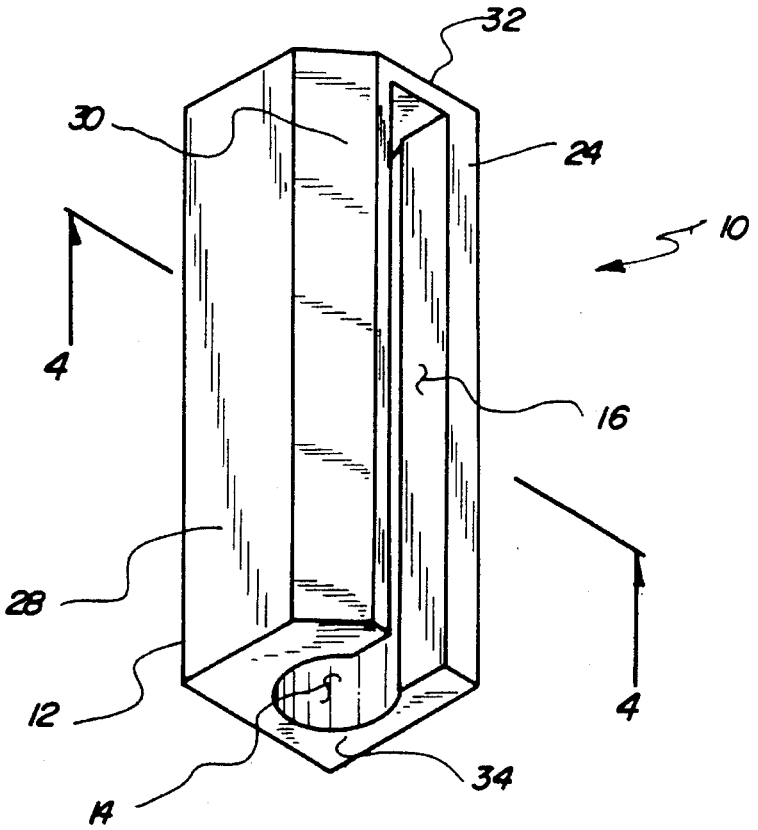
FIG. 3 is a bottom isometric illustration of the door hinge locking device.
Figure 4:
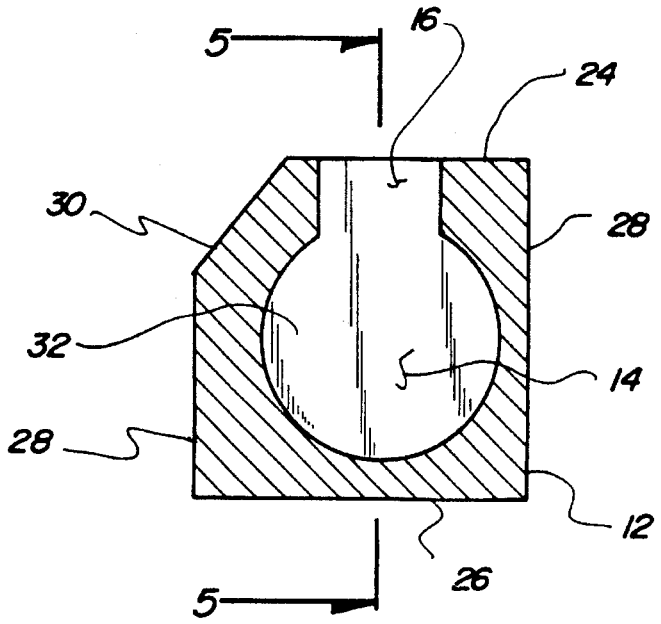
FIG. 4 is a cross-sectional view taken along line 4—4 of FIG. 3.
Figure 6:
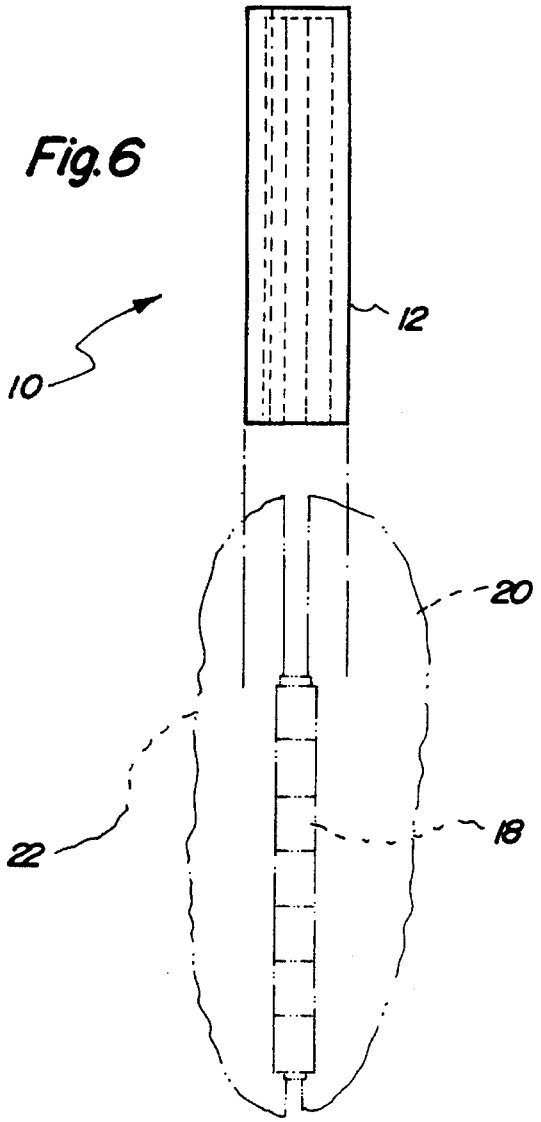
FIG. 6 is an exploded elevation view detailing an installation of the door hinge locking device over a hinge.

More specifically, it will be noted that the door hinge locking device 10 comprises an encapsulating block 12 shaped so as to define a cylindrical bore 14 extending at least partially therethrough, as shown in FIGS. 3 and 4 of the drawings. A rectangular bore 16 extends through the encapsulating block 12 and into contiguous communication with the cylindrical bore 14. The encapsulating block 12 can thus be positioned over a hinge 18 as shown in FIG. 6 of the drawings to preclude pivoting of the hinge to secure a door 20 attached to the hinge relative to a building wall 22 to which the hinge is attached. If desired, a plurality of door hinge locking devices 10 can be utilized to secure a plurality of hinges securing the door 20 to the adjacent building wall 22.

As best illustrated in FIGS. 2 through 5, it can be shown that the encapsulating block 12 is shaped so as to define a flat engaging wall 24 spaced from and oriented substantially parallel to a front wall 26. Lateral walls 28 project substantially orthogonally from opposed longitudinal edges of the front wall 26. A first one of the lateral walls 28 orthogonally intersects the flat engaging wall 24, with a second one of the lateral walls 28 intersecting an angled engaging wall 30. The angled engaging wall 30 extends between the second lateral wall 28 and the flat engaging wall 24 and is oriented so as to extend at oblique angles relative to the walls 24 and 28. The flat engaging wall 28 operates to engage a portion of the door 20, with the angled engaging wall 30 engaging an unlabelled angled portion of the building wall 22. Thus, the engaging walls 24 and 30 cooperate to further resist opening of the door 20 relative to the building wall 22.

Figure 5:
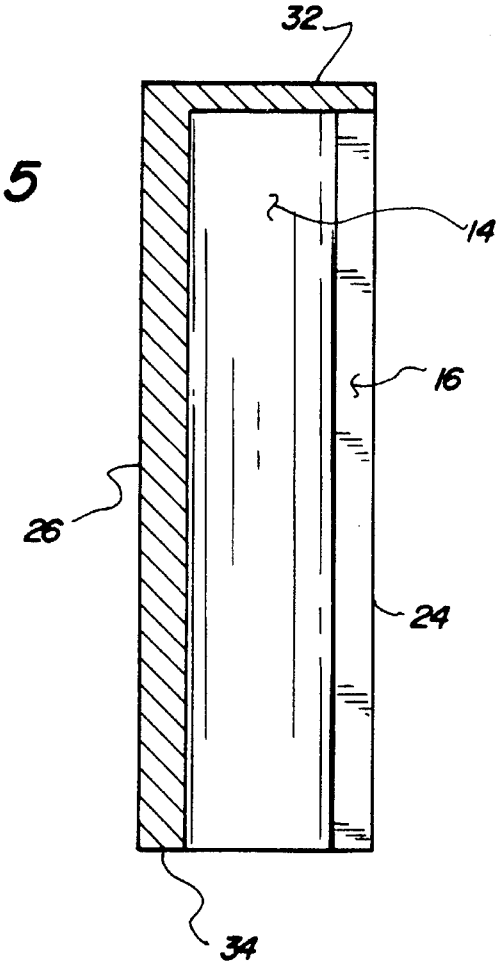
FIG. 5 is a cross-sectional view taken along line 5—5 of FIG. 4.

As shown in FIGS. 3 through 5, the rectangular bore 16 of the encapsulating block 12 is directed through the flat engaging wall and extends therealong. The encapsulating block 12 is shaped so as to define a closed upper end across which an upper wall 32 extends, with a lower wall 34 extending partially across an open lower end of the encapsulating block. The upper and lower walls 32 and 34 are oriented so as to extend substantially orthogonally relative to the remaining walls 24–30 so as to define a rectangular shape of the encapsulating block 12.

In use, the door hinge locking device can be easily positioned over a hinge 18 such as is shown in FIG. 6 to secure plates of the hinge together to preclude opening of the door 20 relative to the building wall 22. The present invention 10 provides an easily usable and quickly disconnectable means for securely securing a door 20 in a closed orientation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door hinge locking device comprising:

an elongated encapsulating block is shaped so as to define a flat engaging wall; and a front wall spaced from and oriented substantially parallel to the engaging wall, the encapsulating block being further shaped so as to define an angled engaging wall extending from the flat engaging wall and being oriented so as to extend at an oblique angle relative thereto, the encapsulating block being still further shaped so as to define lateral walls projecting substantially orthogonally from opposed longitudinal edges of the front wall, with a first one of the lateral walls orthogonally intersecting the flat engaging wall, a second one of the lateral walls intersecting the angled engaging wall, wherein the flat engaging wall operates to engage a portion of the door, and the angled engaging wall operates to engage an angled portion of the building wall to further resist opening of the door relative to the building wall, and the encapsulating block is further shaped so as to define an elognated cylindrical bore extending at least partially therethrough and a rectangular bore extending through one of said walls into contiguous communication with the cylindrical bore, wherein the encapsulating block can be positioned over pivoting cylinders of a hinge to capture and retain plates of the hinge in an abutting relationship to secure a door attached to the hinge relative to a building wall.

2. The door hinge locking device of claim 1, wherein the rectangular bore of the encapsulating block is directed through the flat engaging wall and extends therealong.

3. The door hinge locking device of claim 2, wherein the encapsulating block is shaped so as to define a closed upper end across which an upper wall extends, and a lower wall extending partially across an open lower end of the encapsulating block, the upper and lower walls being oriented so as to extend in a substantially spaced and parallel orientation so as to define a rectangular shape of the encapsulating block.

* * * * *